US007422458B2

(12) United States Patent
Arai

(10) Patent No.: US 7,422,458 B2
(45) Date of Patent: Sep. 9, 2008

(54) WATER RESISTANT CONNECTOR AND CONNECTION CONNECTOR

(75) Inventor: Atsushi Arai, Toyama (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 11/853,155

(22) Filed: Sep. 11, 2007

(65) Prior Publication Data

US 2008/0119078 A1 May 22, 2008

(30) Foreign Application Priority Data

Nov. 22, 2006 (JP) ..... 2006-316341

(51) Int. Cl.
*H01R 13/52* (2006.01)

(52) U.S. Cl. ..... 439/274; 439/587

(58) Field of Classification Search ..... 439/274, 439/275, 279, 283, 587, 687, 328, 464, 465, 439/466, 469, 472, 460, 463, 696
See application file for complete search history.

(56) References Cited

U.S. PATENT DOCUMENTS

| | | | | |
|---|---|---|---|---|
| 3,437,980 | A * | 4/1969 | Smith | 439/469 |
| 4,822,286 | A * | 4/1989 | Bianca | 439/610 |
| 5,021,006 | A * | 6/1991 | Fargeaud et al. | 439/469 |
| 6,059,602 | A * | 5/2000 | Ward | 439/465 |
| 6,261,121 | B1 * | 7/2001 | Harting et al. | 439/469 |
| 7,264,494 | B2 * | 9/2007 | Kennedy et al. | 439/274 |

FOREIGN PATENT DOCUMENTS

JP 2001-210426 A 8/2001

* cited by examiner

*Primary Examiner*—Hae Moon Hyeon
(74) *Attorney, Agent, or Firm*—Darby & Darby P.C.

(57) ABSTRACT

A waterproof connector connects to a cable, and includes a housing where a terminal connected to an end of the cable is inserted and attached, a waterproof tube attached across the periphery of the housing and a periphery of the cable and a fastening cover capable of split fastening from a peripheral side of the waterproof tube.

4 Claims, 8 Drawing Sheets

WATER RESISTANT CONNECTOR AND CONNECTION CONNECTOR

CROSS-REFERENCE TO RELATED APPLICATION

The present application claims priority under 35 U.S.C. §119 to Japanese Patent Application No. 2006-316341, filed Nov. 22, 2006, and which is hereby incorporated herein by reference in its entirety.

FIELD OF THE INVENTION

The present invention relates to a waterproof connector for connecting cables and a relay connector.

BACKGROUND OF THE INVENTION

Waterproof connectors for connecting electrical cables are known in the art. For example, FIG. 7(*a*) illustrates a conventional waterproof connector for interconnecting cables 183 and 193. In preparing the connector assembly, cable wire coverings 183*a* and 193*a* of cables 183 and 193 are peeled back in order for terminals 180 and 190 to be connected to the cable core wire. Next, polyethylene based elastomers 121*b* and 131*b* are formed together with rubber based elastomers 121*a* and 131*a* as a unit so as to be molded around the cable cores 183*b* and 193*b* to assure adherence to the insulative coverings 183*a* and 193*a*.

This approach is used because the waterproofing of housings 121 and 131 cannot be assured if a polyethylene based elastomer is not laid down underneath the rubber based elastomers 121*a* and 131*a* to improve the adherence of the polyethylene cable wire covering to the rubber based elastomers. Not only does this approach increase production costs because the structure is complicated, but also it has been impossible to make connections after adjusting the length of the cable on-site, because the housing must be formed in advance as a unit on the end part of the cable.

FIG. 7 (*b*) illustrates another conventional waterproof connector including a tube 170 that is installed at an interface between a cable 100 and a housing 141 using an adhesive. As with the waterproof connector illustrated in FIG. 7(*a*), the waterproof connector of FIG. 7(*b*) also requires that the length of the cable 100 be determined in advance and that the assembly of cable 100, housing 141 and tube 170 be prepared in advance.

In Published Unexamined Japanese Patent Application No. 2001-210426, a waterproof connector is disclosed for which an elastic sleeve member with a circular truncated cone shape into which the cable is inserted is attached to a conical insertion opening in a housing, and a cover body with a screw screwed in from the outside is applied to fasten the cable to the connector by means the conical insertion opening. In this connector, the adhesion of the elastic sleeve member and the cable vary according to the degree to which the cover body is screwed onto the housing. As a result, it is difficult to control the fastening to have uniform adherence around the entire circumference of the cable.

SUMMARY OF THE INVENTION

In light of the technical problems described above, it is an object of the present invention to provide a highly waterproof connector that can easily be attached to the terminal end of a cable. It is also an object of the present invention to provide a waterproof relay connector with these features.

The present invention is directed to a waterproof connector that connects to a cable. The connector comprises a housing where a terminal connected to an end of the cable is inserted and attached, a waterproof tube that is attached across a periphery of the housing and a periphery of the cable, and a splittable fastening cover capable of from opposing sides of a peripheral side of the waterproof tube.

Through the use of this structure, a terminal connected to a terminal end of the cable is inserted and attached on the inside of a housing. Then, with the waterproof tube inserted across the periphery of the housing and the periphery of the cable, the fastening cover is attached so as to sandwich the periphery of this waterproof tube from the outside.

Therefore, the splitable fastening cover in the present invention opens in a split form along the axial direction of the waterproof tube (i.e., along the direction of the length of the cable) and is attached from the outside of the waterproof tube. When the splittable fastening cover is closed, it forms a cover capable of fastening the periphery of this waterproof tube.

When the fastening cover is given a split shape, the upper and lower covers may be completely separated into two, or the upper and lower covers may be joined on one side with this joined part bent and a split shape formed.

Along with a male cover and a female cover being splitable along the length of the cable, the fastening cover may have small curved ribs that are smaller than the inside circumference of the base parts of the male cover and female cover, the male cover having a fastening protruding piece rising along the outer periphery of the waterproof tube from the curved ribs, and the female cover having a fastening guide surface rising along the outer periphery of the waterproof tube from the curved ribs and sloped toward the center side, and when the male cover and the female cover are attached to the periphery of the waterproof tube, the fastening protruding piece is guided at an angle toward the center along the fastening guide surface and fastens with the waterproof tube on the inside.

The fastening cover comprises a male cover and a female cover, and along with there being provided curved ribs on the inside circumferential surface of the male cover and female cover, the male cover has a fastening protruding piece and the female cover a fastening guide surface slanted toward the center side. Therefore, if the male cover and the female cover are attached so as to sandwich, vertically for example, the waterproof tube from the peripheral side, the curved ribs on the inside circumferential surface of the male cover and the female cover apply pressure to the waterproof tube from, for example, the top and bottom as well as the fastening protruding piece provided on the male cover moving to the center side along the fastening guide surface on the female cover and also providing pressure on the waterproof tube from the side part.

The male cover and the female cover may further include cable pinching claws.

If the male cover and female cover are attached to the periphery of the waterproof tube so as to sandwich the waterproof tube, the fastening protruding piece of the male cover and the fastening guide surface of the female cover are mated and sandwich the waterproof tube. In addition, fastening ribs on the male cover and female cover may be provided.

The waterproof tube waterproofs the interface of the housing and the cable by being installed across the periphery of the housing and the periphery of the cable. Parts of the waterproof tube that are located on the housing periphery and on the cable periphery may be fastened from the outside by a fastening structure to make for secure adhesion of the waterproof tube.

In this case, the fastening structure may be provided in the two locations at the peripheral part of a housing and a peripheral part of the cable. Alternatively, for example, the fastening structure may be provided only on the peripheral part of the waterproof tube corresponding to the peripheral part of the cable and fastening ribs may be provided on the peripheral part of the waterproof tube corresponding to the peripheral part of the housing, which is larger than the outside diameter of the cable.

Cable pinching claws may be further provided that prevent slippage of the cover and the cable on the male cover and the female cover.

The waterproof connector according to the present invention may be used for various cable connectors with the object of waterproofing.

In addition, if a plug terminal connector and the socket terminal connector are paired, it may be used as a waterproof relay connector.

Therefore, it is no longer necessary to form the connector in advance as a unit on the cable end as it was conventionally, and a cable may be cut to the necessary length on site and the waterproof connector attached.

By this means waste in cable length adjustment is eliminated, and the efficiency of wiring operations is improved.

In addition, the fastening cover comprises a male cover and a female cover, and when the male cover and female cover are attached by being fit together so as to sandwich the waterproof tube, there is a concern that the fascinating of the split part of the fastening cover may be insufficient with just the curved ribs on the inside circumference of the male cover and inside circumference of the female cover. However, if a fastening protruding piece is provided on the male cover and a fastening guide surface that is slanted towards the center side is provided on the female cover, a fastening force operates across the entire circumference of the waterproof tube because the fastening protrusion slants toward the center side so that there is pressure on the split part from the side part, and the waterproofing is improved.

BRIEF DESCRIPTION OF THE DRAWINGS

The invention will become more readily apparent from the Detailed Description of the Invention, which proceeds with reference to the drawings, in which:

FIG. 5(*b*) shows a cross-sectional end view through line B-B of FIG. 1(*d*).

FIG. 5(*c*) shows a perspective explanatory view of the attachment protruding pieces and the fastening guide surface parts of FIGS. 5(*a*) and 5(*b*).

FIG. 6(*b*) shows an external plan view after the socket connector and plug connector are joined.

FIG. 7(*b*) shows a waterproof structure for a second conventional connector housing and cable.

DETAILED DESCRIPTION OF THE INVENTION

Figure 1A:
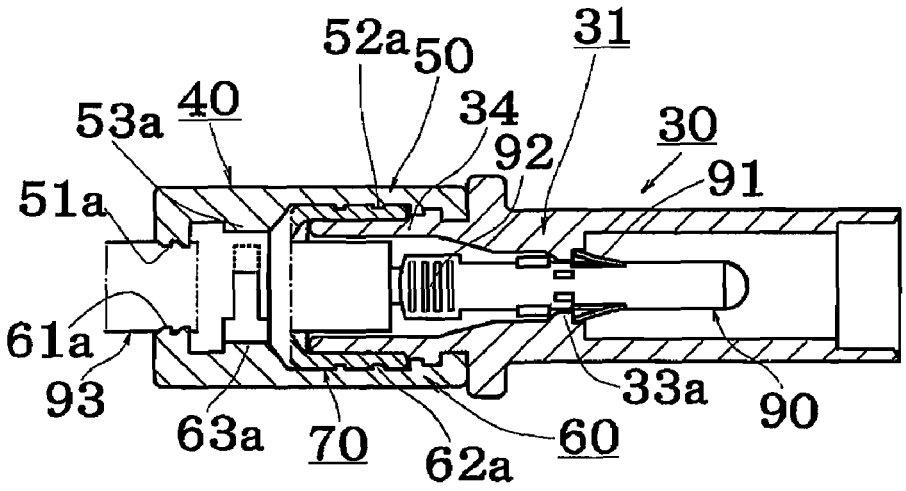
FIGS. 1(*a*) through 1(*d*) show a vertical cross-sectional explanatory view of a relay connector embodiment that makes use of the waterproof connector according to the present invention.
Figure 1B:
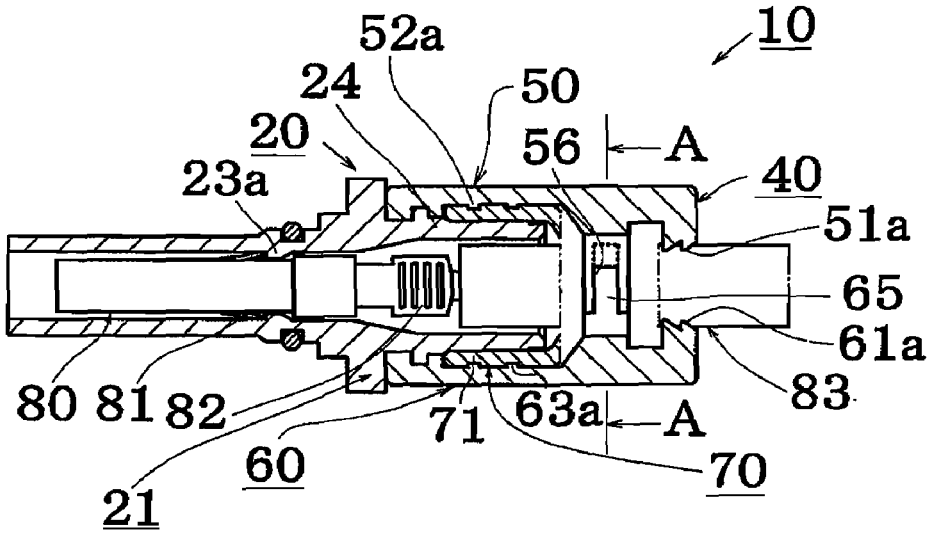
Figure 1C:
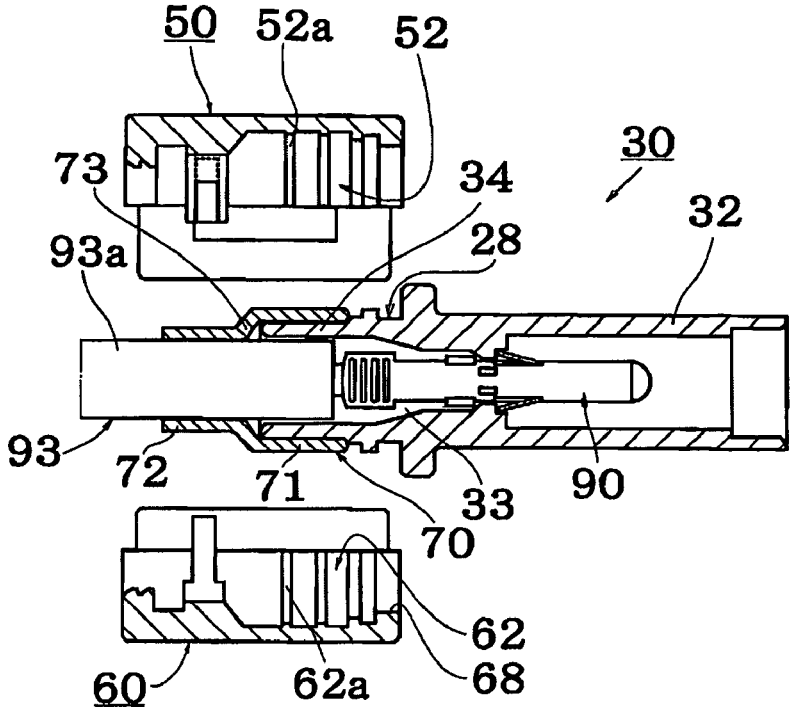
Figure 1D:
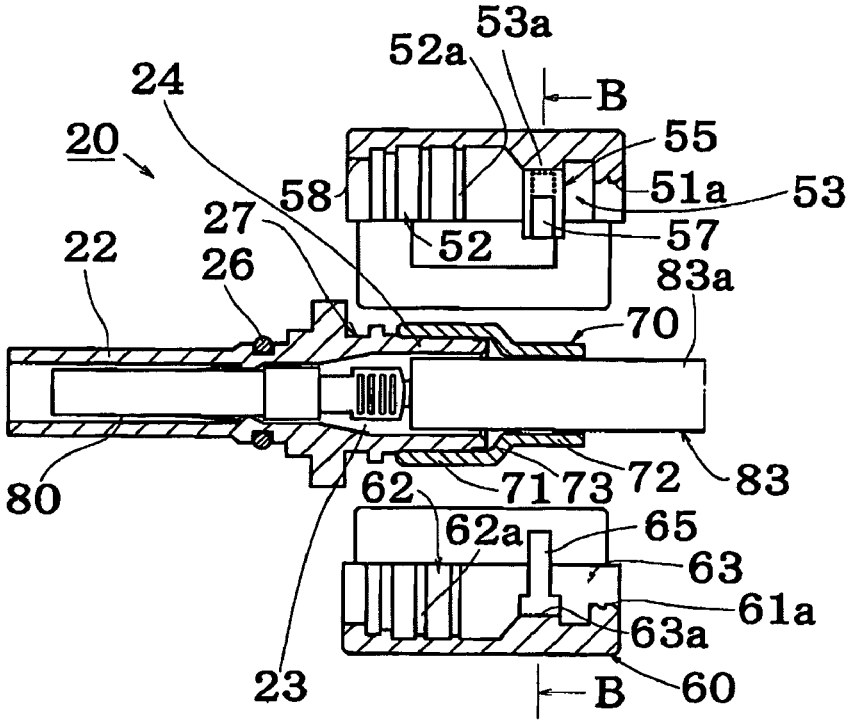

An example using the waterproof connector according to the present invention in a relay connector 10 will be described in detail with reference to the FIGS. 1(*a*) through 6(*b*).

The following table provides a key to the reference elements used in the drawings:

| | | | |
|---|---|---|---|
| 10 | relay connector | 51 | base part |
| 20 | socket connector | 51a | cable pinching claw |
| 21 | socket housing | 52 | housing fitting recessed part |
| 22 | cylindrical barrier wall part | 52a | housing fastening rib |
| 23 | terminal insertion hole | 53 | cable fitting recessed part |
| 23a | securing step part | 53a | curved rib |
| 24 | tube attachment part | 53b | inside surface |
| 25 | housing securing claw | 54 | lock arm |
| 25a | claw part | 54a | lock recessed part |
| 26 | seal member (O-ring) | 54b | edge part of direction of attachment[1] |
| 27 | cover positioning recessed port | 55 | fastening guide member |
| 28 | cover positioning recessed port | 56 | fastening guide groove |
| 30 | plug connector | 56a | insertion recessed part |
| 31 | plug housing | 57 | fastening guide surface |
| 32 | cylindrical barrier wall part | 58 | positioning protruding part |
| 33 | terminal insertion hole | 60 | male cover |
| 33a | securing step part | 61 | base part |
| 34 | tube attachment part | 61a | cable pinching claw |
| 35 | housing securing claw receptacle | 61b | extending piece |
| 40 | fastening cover | 62 | housing fitting recessed part |
| 41 | cable opening | 73 | step part |
| 50 | female cover | 80 | socket terminal |
| 62a | housing fastening rib | 81 | socket terminal lance |
| 63 | cable fitting recessed part | 82 | clinching part |
| 63a | curved rib | 83 | cable |
| 63b | inside surface | 83a | cable covering |
| 64a | main attachment claw | 90 | plug terminal |
| 64b | provisional attachment claw | 91 | plug terminal lance |
| 65 | fastening protruding piece | 92 | clinching part |
| 65a | pressure surface | 93 | cable |
| 65b | end part | 93a | cable covering |

-continued

| | |
|---|---|
| 68 | positioning protruding part |
| 70 | waterproof tube |
| 71 | housing adhesion part |
| 72 | cable adhesion part |

Figure 2:
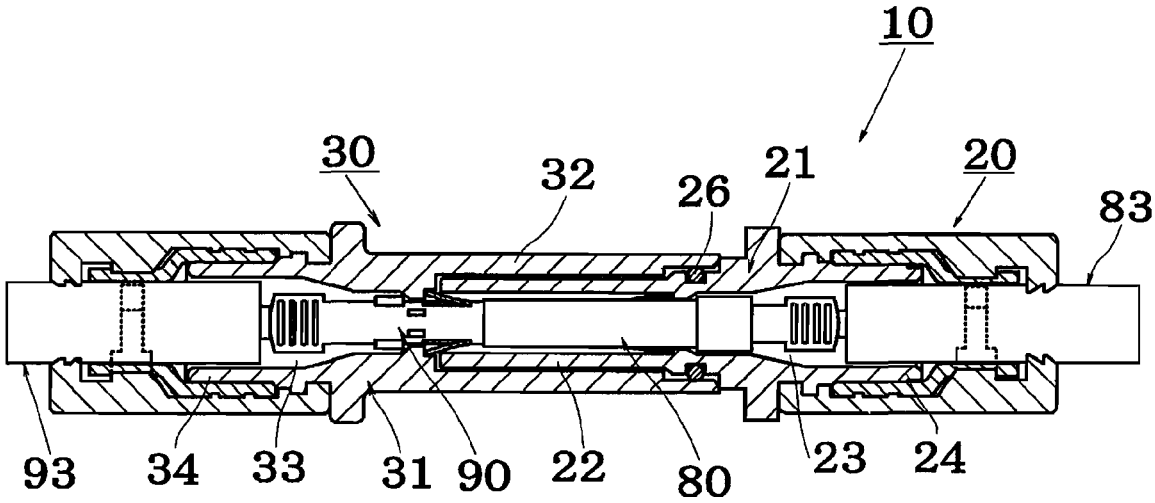
FIG. 2 shows an explanatory diagram of the vertical cross-sectional surface where the socket connector and plug connector are joined.
Figure 3A:
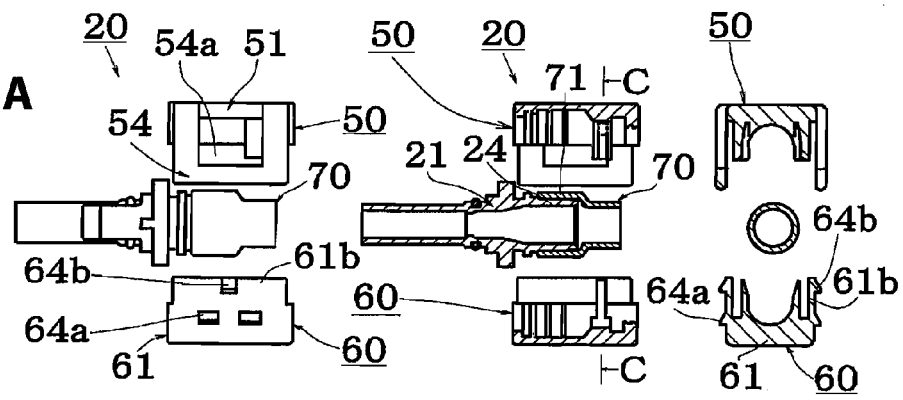
FIGS. 3(*a*) through 3(*d*) show an explanatory diagram of the assembly of the socket connector.
Figure 3B:
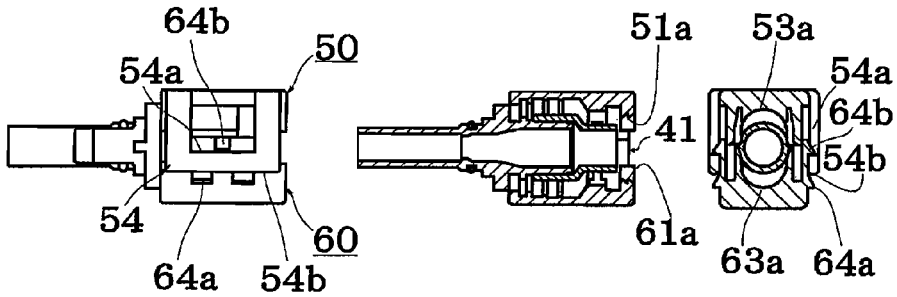
Figure 3C:
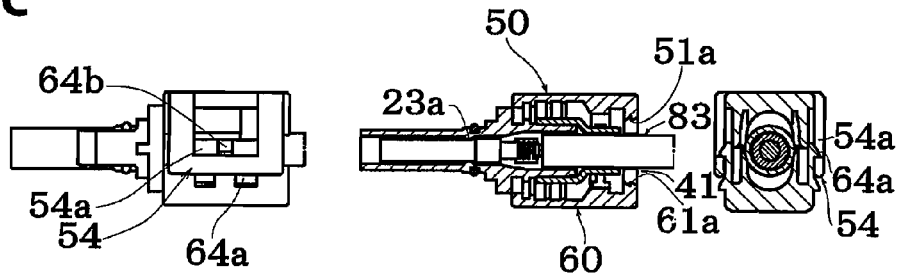
Figure 3D:
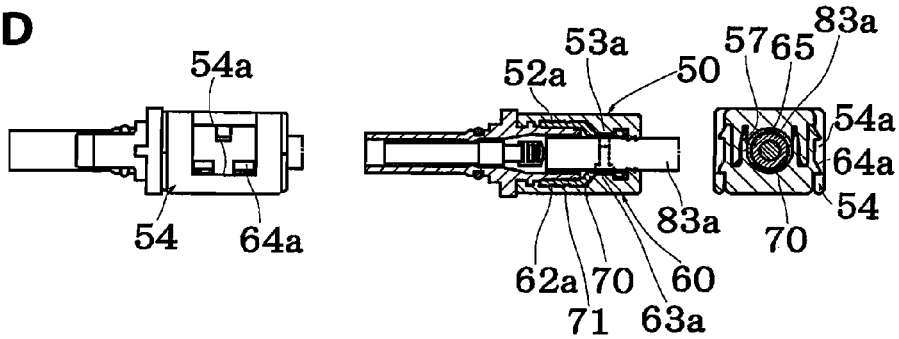
Figure 4A:
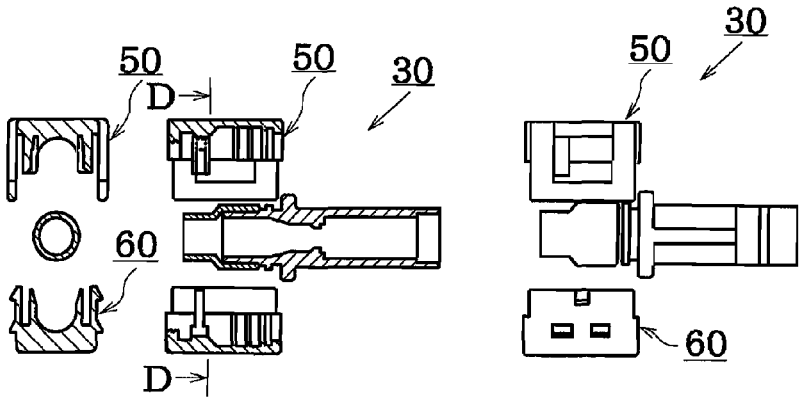
FIGS. 4(*a*) through 4(*d*) show an explanatory diagram of the assembly of the plug connector.
Figure 4B:
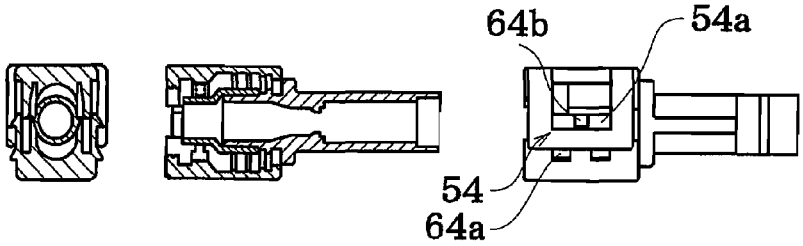
Figure 4C:
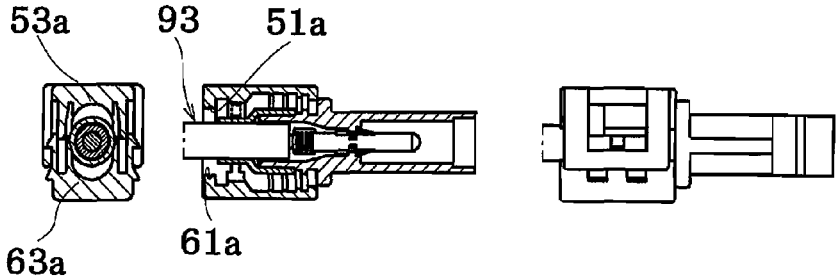
Figure 4D:
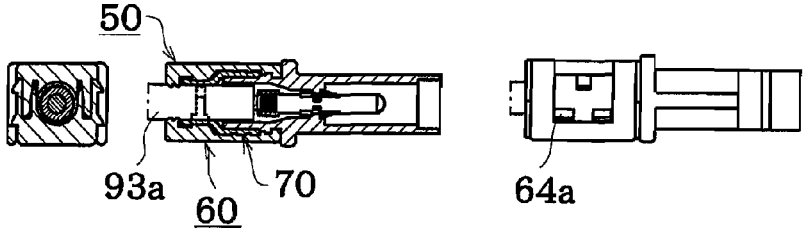

[1]No corresponding reference to this element is provided in the detailed description FIG. 1 (*a*) through 1(*d*) show a cross-sectional views of a socket connector 20 and a plug connector 30 in the state prior to their being joined, and FIG. 2 shows a cross-sectional view of the joined state.

The relay connector 10 comprises the socket connector 20 and the plug connector 30, and each of them have a housing 21, 31, a waterproof tube 70 and a fastening cover 40.

FIGS. 1 (*c*) and 1(*d*) show the state where the fastening cover 40 of FIGS. 1(*a*) and 1(*b*) has been removed.

As is shown in FIG. 2, the socket connector 20 and the plug connector 30 of the relay connector 10 are joined, and terminals 80, 90 in the terminal insertion holes 23, 33 of the housings 21, 31 are conductively connected to each other.

The terminal insertion holes 23, 33 are provided with a socket housing 21 and a plug housing 31, respectively, such that they pass through.

As is shown in FIGS. 1(*c*) and 1(*d*), the cable side opening parts of the terminal insertion holes 23, 33 are provided with tube attachment parts 24, 34 that are made to protrude in a cylindrical form.

Terminals 80, 90, which are attached to the terminal ends of cables 83, 93, pass through the waterproof tube 70 and are installed in the terminal insertion holes 23, 33 from the tube installation part 24, 34 sides.

The terminals 80, 90 are crimp-connected to the terminal end core wires of the cables 83, 93 using clinching parts 82, 92, lances 81, 91 secured to securing step parts 23*a*, 33*a* and the cables 83, 93 sandwiched and held by cable pinching claws 51*a*, 61*a* provided on the fastening covers 40.

Since cover positioning recessed parts 27, 28 are provided on the housing and joined so as to mate with positioning protruding parts 58, 68, they prevent slippage of the fastening covers along with the cable pinching claws.

On the other opening side of the terminal insertion holes 23, 33, the housings 21, 31 are made to protrude in a cylindrical shape, and cylindrical barrier wall parts 22, 32 are provided to extend the terminal insertion holes 23, 33 lengthwise.

The cylindrical barrier wall part 22 for the socket housing 21 is fitted with a ring-shaped sealing member (O-ring) 26 on the peripheral surface.

As is shown in FIG. 2, the cylindrical barrier wall part 22 for the socket housing 21 may be inserted into the cylindrical barrier wall part 32 of the plug connector 30, and the seal member 26 comes into contact with the inside surface of the cylindrical barrier wall part 32 of the plug connector 30 and forms a watertight junction.

By joining the socket connector 20 and the plug connector 30 to each other, the terminal insertion holes 23, 33 that are made watertight with each other by the seal member 26 are linked, and the socket terminal 80 and the plug terminal 90 are joined and connected.

It is sufficient that the waterproof construction of the connecting parts of this socket connector 20 and plug connector 30 be able to form any manner of waterproof connection, and it is not limited to the O-ring sealed structure described above.

The parts for the tube attachment parts 24, 34 for the housings 21, 31, waterproof tube 70 and fastening cover 40 for the socket connector 20 and the plug connector 30 have identical structures.

If the waterproof tube 70 has rubber-like elasticity and is installed across the periphery of the housing and the periphery of the cable, the structure is one where a housing adhesion part 71 in a cylindrical tube shape and a cable adhesion part 72 are elastically connected to a step part 73. (See, for example, FIGS. 1(*a*)-1(*d*).)

The inside diameter of the housing adhesion part 71 is smaller than the outside diameter of the tube attachment parts 24, 34, and when it is inserted into the tube attachment parts 24, 34, the inner circumference adheres elastically on the outer peripheral surface of the tube attachment parts 24, 34 so as to be waterproof.

The inside diameter of the cable adhesion part 72 is equal to or slightly larger than the external form of the outer coverings 83*a*, 93*a* of the cables 83, 93 and the cables 83, 93 that are connected to the terminals 80, 90 may easily be passed through.

The fastening cover 40 has the female cover 50 and male cover 60 as is shown in FIGS. 1(*c*) and 1(*d*) and they have housing fitting recessed parts 52, 62 and cable fitting recessed parts 53, 63, respectively.

The female cover 50 and male cover 60 mate the housing fitting recessed parts 52, 62 to the parts for the tube attachment parts 24, 34, mate the cable fitting recessed parts 53, 63 to cable coverings 83*a*, and 93*a*, and may be joined to each other as shown in FIGS. 1 (*a*) and 1(*b*).

Housing fastening ribs 52*a*, 62*a* are provided on the housing fitting recessed parts 52, 62, and curved ribs 53*a*, 63*a* are provided on the cable fitting recessed parts 53, 63.

By having the housing fastening ribs 52*a*, 62*a* and the curved ribs 53*a*, 63*a* fasten the female cover 50 and male cover 60 to each other as shown in FIGS. 1(*a*) and 1(*b*), the housing fastening ribs 52*a*, 62*a* apply pressure in the direction of fastening to the waterproof tube 70 on the tube attachment parts 24, 34. The curved ribs 53*a*, 63*a* apply pressure in the direction of attachment to the waterproof tube 70 on the cable coverings 83*a*, 93*a* outside of the tube attachment part 24, 34.

The fitting structure of this female cover 50 and male cover 60 will be described in the following.

Figure 5A:
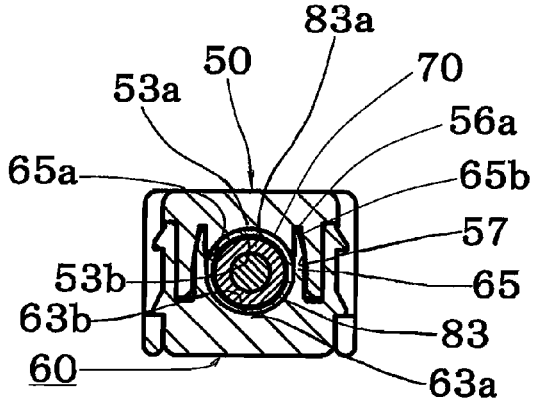
FIG. 5 (*a*) shows a cross-sectional end view through line A-A of FIG. 1(*b*).
Figure 5B:
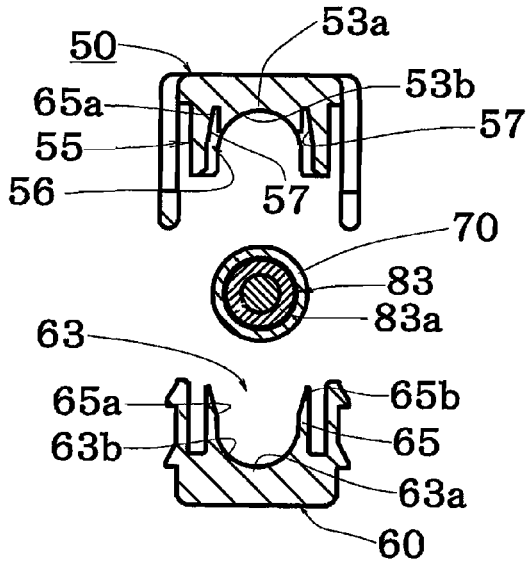
Figure 5C:
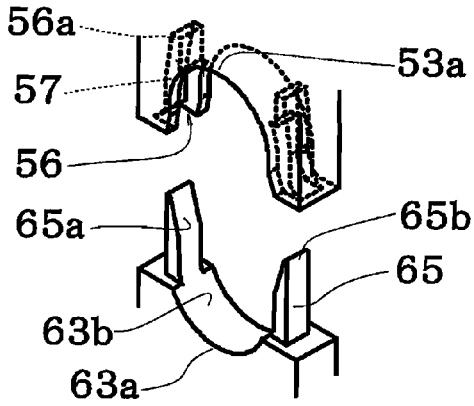

FIG. 5(*a*) shows cross-sectional end surface view through the line A-A in FIG. 1 (*b*), and a cross-sectional end surface view through line B-B in FIG. 1 (*d*) is shown in FIG. 5(*b*).

In addition, FIG. 5 (*c*) shows a perspective explanatory view of fastening protruding pieces 65 and the parts for fastening guide pieces 57.

As is shown in FIG. 5 (*b*), the curved ribs 53*a*, 63*a* have an inside surface length smaller than a semicircle, and have a rib shape which has inner circumferential surfaces 53*b*, 63*b* matched to the shape of the periphery of the cable surface 83*a*.

Fastening guide members 55 protruding in the direction of attachment are provided on both end positions of the curved ribs 53*a* provided on the female cover 50, and fastening guide grooves 56 are provided in the direction of attachment on the fastening guide members 55. Fastening guide surfaces 57 are formed along the direction of attachment.

The fastening protruding pieces 65 are formed so as to protrude in the direction of attachment on both end positions of the curved ribs 63*a* provided on the male cover 60.

When the female cover 50 and the male cover 60 are joined as shown in FIG. 5 (*a*), the curved ribs 53*a*, 63*a* apply pressure to the upper part of the cable covering 83*a* of the waterproof tube 70 all along the peripheral direction so as to sandwich it between them, and the waterproof tube 70 is made to adhere to the cable covers 83*a*, 93*a* so as to be waterproof.

At this time, the fastening protruding pieces 65 are slid and guided into the fastening guide surfaces 57, which rise along the outer periphery of the waterproof tube 70 from the curved rib 53*a* and are sloped as they rise toward a center side in the direction of a vertical plane through the central axis of the cable 83. The fastening protruding pieces 65 are thereby deflected toward the inside of a substantially perpendicular direction to the direction of attachment in the direction of the central axis of the cable 83, and the end parts 65*b* are mated to insertion recessed parts 56*a* of the fastening guide grooves 56.

The fastening protruding pieces 65 apply pressure by this means to the cable covering 83*a* parts of the waterproof tube 70 with the pressure surface 65*a* on the inside and make the waterproof tube 70 adhere to the cable covering 83*a* so as to be waterproof. At this time, the part of the waterproof tube 70 that is pressed by the inside surfaces 53*b* and 63*b* of the curved ribs and 53*a*, 63*a* and the part of the waterproof tube 70 pressed by the pressing surfaces 65*a* of the fastening protruding pieces 65 are substantially continuous in the direction of the circumference of the cable coverings 83*a*, 93*a*, so the waterproof tube 70 is made to adhere to the cable covering 83*a* in the direction of the circumference in a substantially uniform and continuous manner so as to be waterproof.

Figure 6A:
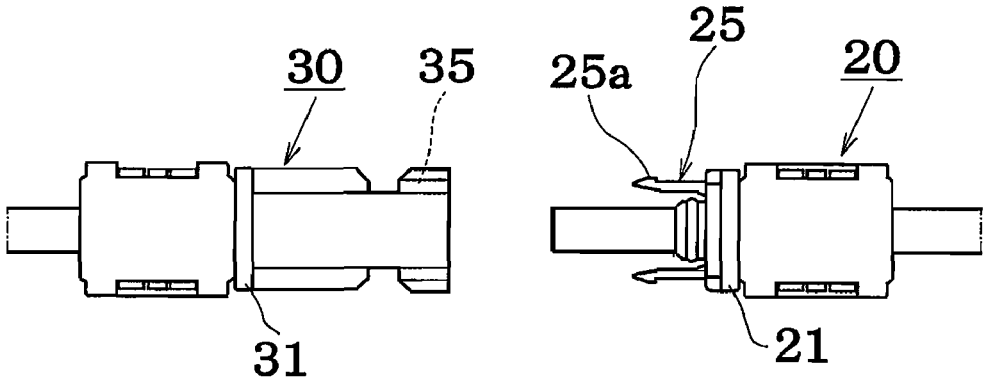
FIG. 6(*a*) shows an external plan view of the socket connector and plug connector before they are joined.
Figure 6B:
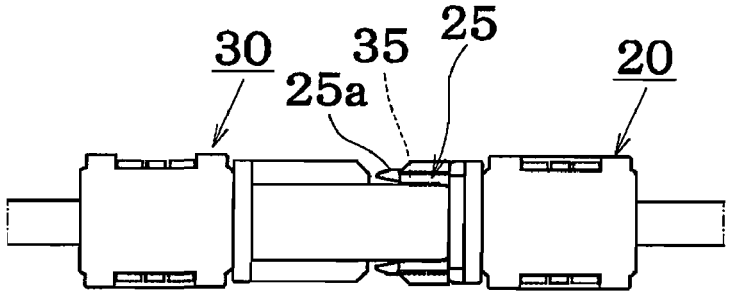
Figure 7A:
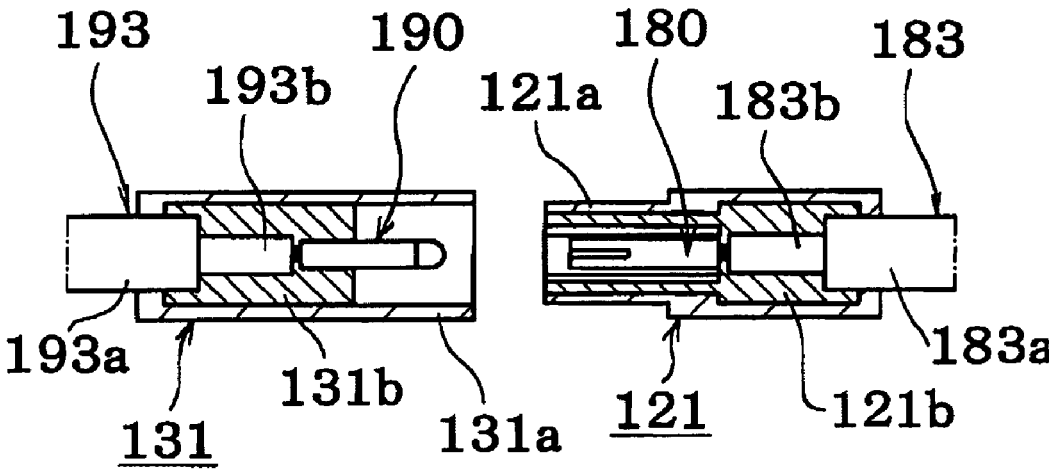
FIG. 7A (Prior Art)
FIG. 7(*a*) shows a waterproof structure for a first conventional connector housing and cable.
Figure 7B:
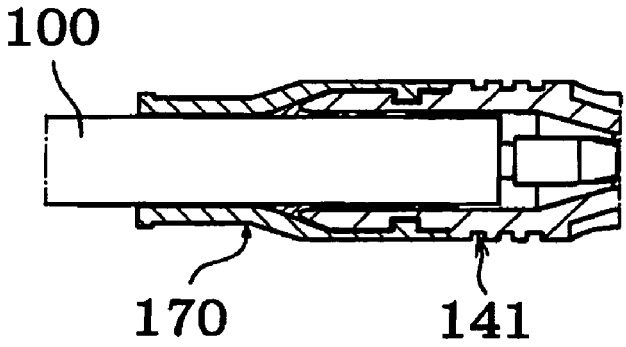
FIG. 7B (Prior Art)

FIG. 6 (*a*) shows external plan view of the socket connector 20 and the plug connector 30 prior to their being joined, and FIG. 6 (*b*) shows an external plan view after they have been joined.

Housing securing claws 25, which are oriented in the direction of attachment on the socket connector 20, are provided having a claw part 25*a* at the tip, and housing securing claw receptacles 35, which are pierced in the direction of attachment, are provided so as to correspond to the position of the housing securing claws 25.

If the socket housing 21 and the plug housing 31 are joined to each other as shown in FIG. 1 (*b*), the housing securing claws 25 snap into and engage the housing securing claw receptacles 35, and the socket connector 20 and plug connector 30 junction is secured.

Next, the procedure for connecting the connector and cable will be described for the fastening cover attachment structure.

FIGS. 3(*a*)-3(*d*) show an explanatory diagram of the procedure for connecting the cable 83 to the socket connector 20, and FIGS. 4(*a*)-4(*d*) show an explanatory diagram of the procedure for connecting the cable 93 to the plug connector 30.

To make it easy to understand, each of FIGS. 3(*a*)-3(*d*) has in order from the left drawings of an external view of the side surface of the socket connector 20, of vertical cross-sectional view in the direction of the cable and a cross-sectional end surface view corresponding to the line C-C. Each of FIGS. 4(*a*)-4(*d*) has in order from the right drawings of an external view of the side surface of the plug connector 30, a vertical cross-sectional view in the direction of the cable and a cross-sectional end surface view corresponding to the line D-D.

The cable is inserted and installed in the connector housing, and the structure of the fastening cover that is attached is common to the socket connector 20 and the plug connector 30, so the case for this socket connector 20 will be described for representation.

FIG. 3 (*a*) shows the state where the housing adhesion part 71 of the waterproof tube 70 is put on the tube attachment part 24 of the socket connector housing 21 before the female cover 50 and the male cover 60 are attached.

A lock arm 54 is provided on the female cover 50 extending toward the side of the direction of attachment from the side surface of a base part 51 with a substantially U-shape with a lock recessed part 54*a* on the inside.

An extending piece 61*b* that has the side surface of the base broadened on the side in the direction of attachment is provided on the male cover 60, and a provisional attachment claw 64*b* is provided on the side surface of the extending peace 61*b*. The main attachment claw 64*a* is provided on the side surface at a prescribed interval from the provisional attachment claw 64*b* in the direction of attachment.

By fitting the lock recessed part 54*a* of the lock arm 54 in a state where it engages the provisional attachment claw 64*b* of the male cover 60 while the end part 54 on the side of the lock arm 54 in the direction of attachment abuts the main attachment claws 64*b* as is shown in FIG. 3 (*b*), a space is opened between the curved ribs 53*a*, 63*a* for the female cover 50 and the male cover 60, and there is an attached state where a cable opening 41 is opened between the cable pinching claws 51*a*, 61*a* of base parts 51, 61, respectively.

For the description, this attached state for the female cover 50 and the male cover 60 where this cable opening 41 is opened is called the provisional attached state.

In this provisional attached state, the female cover 50 and the cover 60 with the fastening surface are handled easily without coming apart from the housing 21, and furthermore, the cable 83 with the socket terminal 80 attached to the terminal end may easily pass through the cable of opening 41 and be installed at the prescribed position in the terminal insertion hole 23 as shown in FIG. 3 (*c*).

If the fastening of the female cover 50 in the male covers 60 is deepened from this provisional attached state and the lock arm 54 moves over the main attachment claws 64*a*, the lock recessed part 54*a* engages the main attachment claws 64 a as shown in FIG. 3 (*d*).

For the description this attached state is called the main attached state.

In this main attached state, the curved ribs 53*a*, 63*a* apply pressure to the waterproof tube 70 toward the cable covering 83*a* from the side of the direction of attachment as shown in FIG. 5 (*a*), and the fastening protruding pieces 65 apply pressure to the waterproof tube 70 toward the cable covering 83*a* from the side in a direction substantially parallel to the direction of attachment. The waterproof tube 70 adheres continuously to the cable covering 83*a* in the circumferential direction in a waterproof manner.

At this time, the housing adhesion part 71 of the waterproof tube 70 adheres to the tube attachment part 24 continuously in a waterproof manner in the circumferential direction. Furthermore, the housing fastening ribs 52*a*, 62*a* formed in the housing fitting recessed parts 52, 62 apply pressure to the outside surface of the housing adhesion part 71 toward the tube attachment part 24, and the inside surface of the waterproof tube 70 is made to adhere to the tube attachment part 24.

By this means, the inside surface of the waterproof tube 70 adheres in a waterproof manner to both the housing 21 side and a cable 83 side in the circumferential direction in this main attached state, and the interface part of the housing 21 and the cable 83 is made waterproof.

A relay connector was described as an example of the application of the waterproof connector according to the present invention, but it may be applied to various types of connectors, and also in the case of relay connectors that connect solar cells to each other in solar systems, many solar cells may be easily connected.

What is claimed is:

1. A waterproof connector that connects to a cable, comprising:

a housing where a terminal connected to an end of the cable is inserted and attached, a waterproof tube attached across the periphery of the housing and the periphery of the cable and a fastening cover capable of split fastening from a peripheral side of the waterproof tube to provide a waterproof seal between the housing and the cable, the fastening cover including:

a male cover and a female cover splittable along the length of the cable, and curved ribs that have a smaller inside circumference than the inside circumference of base parts of the male cover and female cover through which the cable extends, wherein:

the male cover has a fastening protruding piece rising along the outer periphery of the waterproof tube from the curved ribs, and the female cover has a fastening guide surface rising along the outer periphery of the waterproof tube from the curved ribs and sloped toward the center side, such that when the male cover and the female cover are attached to the outer periphery of the waterproof tube, the fastening protruding piece is guided at an angle toward the center of the fastening cover along the fastening guide surface and fastens with the waterproof tube being sandwiched on the inside.

2. The waterproof connector according to claim 1, wherein there are mated ribs that fasten to the waterproof tube on the inner circumference of the male cover and the female cover.

3. The waterproof connector according to claim 1, further having cable pinching claws in one ore more of the male cover and female cover.

4. A relay connector that uses a pair of the waterproof connectors according to claim 1, wherein a terminal of a first one of the pair of connectors is a plug terminal and a terminal of the other one of the pair of connectors is a socket terminal.

* * * * *